United States Patent [19]

Entringer

[11] Patent Number: 4,836,810

[45] Date of Patent: Jun. 6, 1989

[54] COMBINED POWER TRIM AND STEERING SYSTEM

[75] Inventor: David C. Entringer, Fond du Lac, Wis.

[73] Assignee: Brunswick Corporation, Skokie, Ill.

[21] Appl. No.: 176,886

[22] Filed: Apr. 4, 1988

[51] Int. Cl.[4] ..... B63H 21/26

[52] U.S. Cl. ..... 440/61; 440/53

[58] Field of Search ..... 440/53, 61, 88, 900, 440/63; 114/150, 144 R

[56] References Cited

U.S. PATENT DOCUMENTS

| | | | |
|---|---|---|---|
| 3,915,111 | 10/1975 | Buddrus | 440/53 |
| 4,050,359 | 9/1977 | Mayer | 440/61 |
| 4,490,120 | 12/1984 | Hundertmark | 440/61 |
| 4,544,362 | 10/1985 | Arneson | 440/61 |

*Primary Examiner*—Joseph F. Peters, Jr.

*Assistant Examiner*—Edwin L. Swinehart

*Attorney, Agent, or Firm*—Andrus, Sceales, Starke & Sawall

[57] ABSTRACT

The power steering and trim functions of a marine drive unit are combined in a fluid pressure supply system which utilizes a single electric motor drive hydraulic pump to provide operating fluid for both functions. Fluid pressure to operate the power steering is supplied by an accumulator which, in turn, is charged by the hydraulic pump. The pump is also operable in response to operator input to supply fluid pressure for the trim system. Appropriate controls, responsive to the upper and lower pressures limits of the accumulator, are used both for charging the accumulator and for providing operational priority to the power steering system by disabling operation of the trim system during charging of the accumulator.

5 Claims, 1 Drawing Sheet

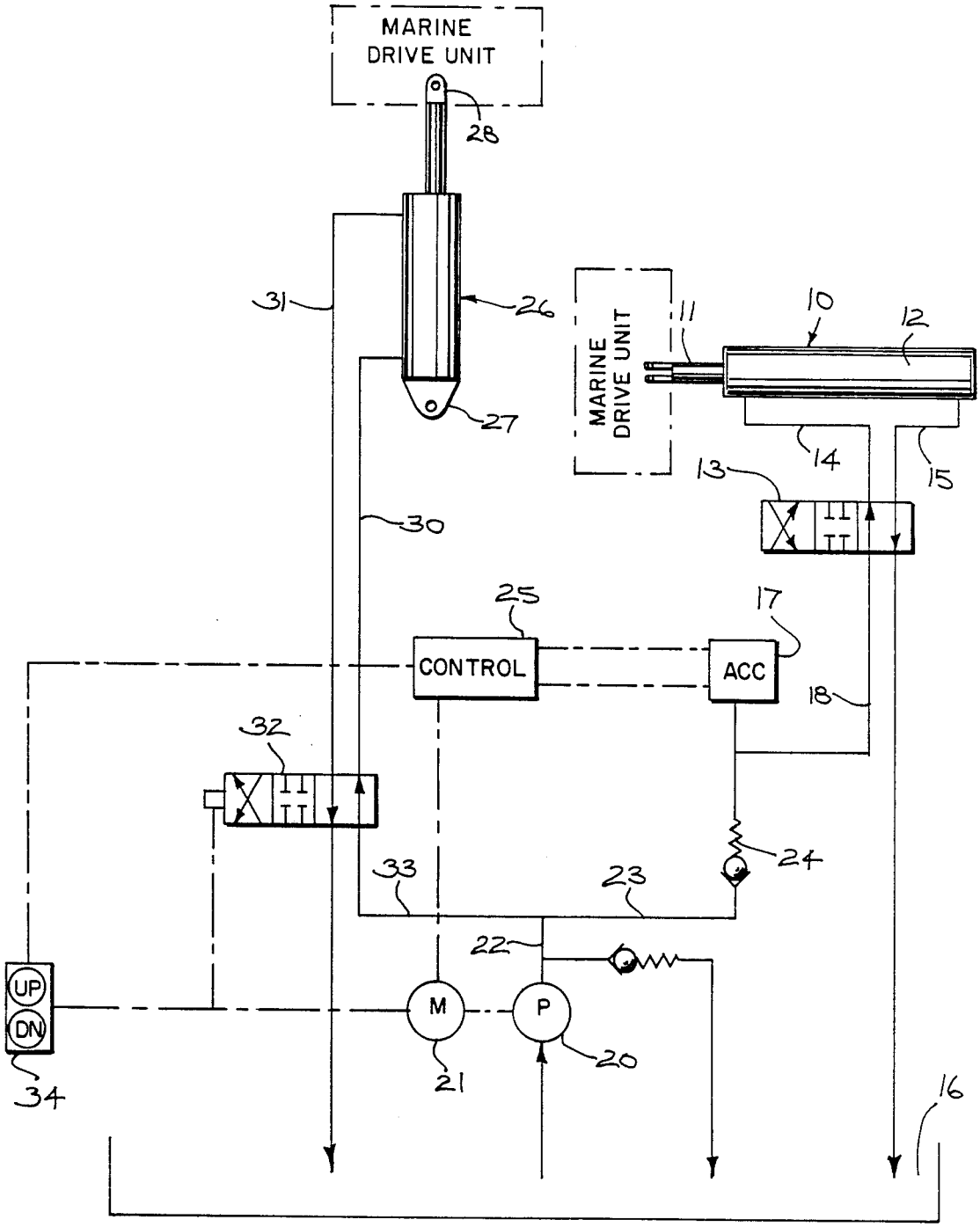
MARINE DRIVE UNIT
28
31
26
27
MARINE DRIVE UNIT
11
10
12
14
15
13
30
25
17
CONTROL
ACC
18
32
24
33
23
22
UP
DN
M
P
21
20
34
16

COMBINED POWER TRIM AND STEERING SYSTEM

BACKGROUND OF THE INVENTION

The present invention relates to systems for steering and for trimming a marine drive unit and, more particularly, to a single combined system for the operation of hydraulic power steering and trim systems.

A power steering system for a typical transom-mounted marine drive unit utilizes a hydraulic assist to reduce steering loads to the operator. The steering arm of the marine drive, which pivots the drive unit about a generally vertical axis, is connected to the piston rod of a double-acting hydraulic cylinder and the cylinder housing is attached to the boat. The steering wheel of the boat is connected through a steering cable to a movable valve that controls the direction and volume of hydraulic fluid supplied to the cylinder. The operator of the boat thus needs only to exert enough effort to operate the valve and not the total effort required to actually steer the boat.

A power trim system for a marine drive also employs a double-acting hydraulic cylinder or cylinders to pivot the drive unit about a generally horizontal axis to adjust the drive angle of the propulsion unit with respect to the boat for on-plane and off-plane operation. Fluid power to operate the cylinder to raise or lower the drive unit is provided by a reversible pump, such as a gear pump, and controlled by a shuttle valve which is operated by pump pressure and direction.

Typically, a power steering system and a power trim system each utilizes a separate hydraulic pump to generate the required fluid pressure. Power steering system pumps are, further, typically driven by the engine used to power the boat. Trim systems, on the other hand, most commonly use a separate electric motor to drive the trim system pump. Using the boat engine to drive the hydraulic pump for the power steering system helps assure that the system will be operative for steering whenever the boat is moving under the power of the engine. A separate electric motor to power the trim system pump offers the advantage of permitting the drive unit to be trimmed or tilted up out of the water when the engine is not running.

Pending U.S. patent application Ser. No. 079,097, filed July 29, 1987 and assigned to the assignee of the present application, discloses a power steering system which uses an electric motor to drive the hydraulic pump. In that system, a hydraulic accumulator is disposed between the pump and the cylinder control valve to provide the direct source of fluid pressure for the system. The accumulator is periodically pressurized by automatic activation of the electric motor and pump to maintain the fluid pressure in the accumulator and available to operate the power steering between selected maximum and minimum limits. Use of an accumulator also eliminates the need to have the hydraulic pump and motor operating continuously.

U.S. Pat. No. 4,490,120 shows a hydraulic system for trimming and tilting an outboard motor in which a single electric motor driven pump powers a pair of hydraulic trim cylinders and a single hydraulic tilt cylinder. U.S. Pat. No. 4,050,359 describes a system in which a pair of hydraulic cylinders provides combined trim and tilt functions, the latter to pivot the outboard motor to its highest position as for trailering. U.S. Pat. No. 3,915,111 discloses a hydraulic marine propulsion device in which the trim/tilt system and the power steering system are each operated by a separate hydraulic pump.

Thus, basic differences between trim/tilt systems and steering systems, such as the required operating pressures and the nature of the duty cycle, have lead to substantially different system design and operation. For example, a trim system typically utilizes a reversible gear pump, whereas a power steering system may typically use a high volume, unidirectional device, such as a vane pump.

Despite the differences in the two systems described above, it would be desirable to utilize a common fluid pressure supply for the combined operation of the trim/tilt and power steering systems in a boat.

SUMMARY OF THE INVENTION

In the present invention, a common fluid pressure supply apparatus operates both the hydraulic power steering system and the hydraulic trim or trim/tilt system for the drive unit of a marine propulsion device. A single electric motor driven hydraulic pump supplies fluid pressure to charge an accumulator which, in turn, is used to supply fluid pressure for the power steering system. A first control means is responsive to upper and lower fluid pressure limits to operate the pump to maintain the fluid pressure in the accumulator within an operative range. A separate branch from the pump outlet supplies pressurized fluid to the up-trim and down-trim circuits of the hydraulic trim cylinder via a connecting valve means which is responsive to a second control means which control means simultaneously activates the electric motor to drive the hydraulic pump. The system also includes lock-out means to prevent operation of the trim/tilt system while the accumulator is being charged.

BRIEF DESCRIPTION OF THE DRAWING

The single drawing FIGURE is a schematic representation of the combined power trim and power steering system of the present invention.

DETAILED DESCRIPTION OF THE PREFERRED EMBODIMENT

A first power steering cylinder 10 comprises a double acting hydraulic cylinder having a rod end 11 which is attached to the steering arm of a marine drive (not shown). The marine drive may be either an outboard motor or a stern drive unit. The cylinder end or housing 12 of the power steering cylinder is mounted in a fixed position to the boat. Extension and retraction of the rod end 11 will impart turning movement in opposite directions to the drive unit. Fluid pressure to operate the power steering cylinder 10 is controlled by a control valve 13 which is movable to supply fluid to either the rod end or the cylinder end in response to opposite turning movements of the steering wheel by the boat operator. With the valve 13 in the position shown, pressurized hydraulic fluid is being supplied to the rod end 11 via a supply line 14 to cause the rod to be retracted, while fluid in the cylinder end 12 is returned via return line 15 to a reservoir 16. Movement of the valve 13 to the reversing position, as a result of operator turning movement in the opposite direction, will cause extension of the rod and reverse flow of hydraulic fluid in liner 14 and 15.

Fluid pressure to operate the power steering cylinder 10 is supplied by a hydraulic accumulator 17 via supply line 18. The accumulator 17 is charged or pressurized by a hydraulic pump 20 driven by an electric motor 21. Pressurized fluid flows from the pump outlet 22, into first branch line 23, past check valve 24 and into the accumulator 17. The accumulator 17 may be of any conventional type in which the hydraulic fluid is pressurized by a movable piston biased by a chamber of a compressed gas. One such accumulator is described in pending application Ser. No. 079,097, identified above. Suitable sensor means monitor the pressure in the accumulator and generate signals utilized to operate the pump 20 to maintain the pressure between upper and lower limits. The sensors may, for example, sense the position of the pressure-biased piston in the accumulator or sense the actual pressure of the compressed gas in the chamber behind the piston. In any event, appropriate signals are generated by the sensor means and fed to a control module 25, such that a sensed condition of low accumulator pressure will cause the motor 21 to start and operate the pump 20 to charge the accumulator 17. A signal representative of the sensed condition of the high pressure limit will, likewise, be fed to the control 25 to cause the motor 21 to stop.

Trimming or tilting movement of the drive unit is provided by a double acting trim cylinder 26. Trim cylinder 26 includes a cylinder end 27 which is typically pivotally attached to the boat transom or to the outboard motor mounting bracket, and a rod end 28 which is typically pivotally attached to the drive unit or the motor. Fluid pressure supplied to the cylinder end 27 via an up trim supply line 30 will result in extension of the cylinder rod and an out-trim or upward pivotal lifting of the drive unit. Conversely, fluid pressure supplied to the rod end 28 via a down trim supply line 31 will result in retraction of the cylinder rod and the in-trim or lowering of the drive unit.

Control of the fluid pressure for operating the trim cylinder 26 is provided by a solenoid operated reversing valve 32. An electrical signal to simultaneously position the valve 32 and activate the motor 21 to drive pump 20 is supplied by the manual input of the boat operator via a trim switch 34. Thus, as shown in the drawing, operator activation of the "up" button of trim switch 34 will position the valve 32 such that pump 20 will supply pressurized fluid via a second branch line 33 to the up trim supply line 30 and the cylinder end 27 of the trim cylinder 26, resulting in extension of the cylinder rod to pivot or trim the drive unit upwardly. Simultaneously, hydraulic fluid in the rod end 28 of the cylinder will be returned via the down trim supply line 31, through the valve 32 and into the reservoir 16.

In the combined power steering and trim/tilt system thus far described, it is preferable for both safety and convenience of operation to provide operational priority to the power steering system to assure that power steering is always available. Operation of the trim system, on the other hand, is neither as frequent as the need for power steering nor as important to safe operation of the boat. Therefore, the manually operated trim switch 34 includes an appropiate lock-out operative by a signal from the control module 25 to disable operation of the trim system whenever the pump 20 is being operated to charge the accumulator 17. Most conveniently, the same signals generated in response to the sensed lower and upper fluid pressure limits in the accumulator may be used to disable and reenable the trim system. The reversing valve 32 must be held in a neutral position during operation of the trim system lock-out so fluid flow through the valve in either direction is prevented.

Various modes of carrying out the invention are contemplated as being within the scope of the following claims particularly pointing out and distinctly claiming the subject matter which is regarded as the invention.

I claim:

1. In a watercraft having a drive unit, an hydraulically operated power steering system operatively attached to the drive unit for steering the watercraft, and an hydraulically operated trim system operatively attached to the drive unit for raising and lowering the drive unit with respect to the watercraft, a common fluid pressure supply apparatus for said systems comprising:

an electric motor-driven hydraulic pump including an outlet for supplying hydraulic fluid under pressure;

an accumulator for receiving hydraulic fluid from the pump outlet and for supplying pressurized fluid to the power steering system;

first control means responsive to upper and lower fluid pressure limits for periodically operating the pump to maintain the fluid pressure in the accumulator within said limits;

fluid supply means for carrying pressurized fluid to the trim system for raising and lowering the drive unit;

valve means for connecting the pump outlet with said fluid supply means;

second control means for operating the valve means and simultaneously activating the pump; and, lock-out means for disabling the second control means during operation of the pump by the first control means.

2. The apparatus as set forth in claim 1 wherein said first control means is automatically responsive to said pressure limits.

3. The apparatus as set forth in claim 1 wherein the fluid supply means comprises an up-trim supply line and a down-trim supply line.

4. The apparatus as set forth in claim 3 wherein the second control means is manually operable to selectively connect the pump outlet with one of said supply lines.

5. The apparatus as set forth in claim 4 wherein the valve means comprises an electrically-operated reversing valve.

* * * * *